US007252201B1

(12) United States Patent
Savage

(10) Patent No.: US 7,252,201 B1
(45) Date of Patent: Aug. 7, 2007

(54) DESIGNER DORM ROD

(76) Inventor: Crystal Savage, 5202 N. Marshall St., Philadelphia, PA (US) 19120

( * ) Notice: Subject to any disclaimer, the term of this patent is extended or adjusted under 35 U.S.C. 154(b) by 222 days.

(21) Appl. No.: 11/059,879

(22) Filed: Feb. 16, 2005

Related U.S. Application Data

(60) Provisional application No. 60/546,644, filed on Feb. 20, 2004.

(51) Int. Cl.
*A47H 1/08* (2006.01)

(52) U.S. Cl. ..... 211/105.6

(58) Field of Classification Search ..... 211/105.1, 211/105.6; 160/330, 340, 341, 123, 124, 160/126, 38, 39, DIG. 6; 248/252, 254, 248/255

See application file for complete search history.

(56) References Cited

U.S. PATENT DOCUMENTS 961,352 A * 6/1910 Walters ..... 211/105.6
1,435,613 A * 11/1922 Miller ..... 248/252
1,564,328 A * 12/1925 Cutting ..... 160/112
1,814,066 A * 7/1931 Wendel ..... 248/252
2,169,053 A * 8/1939 Lowe ..... 248/263
2,242,683 A 5/1941 Scott
2,257,014 A 9/1941 Jacobson
2,374,165 A * 4/1945 Arrie ..... 248/254
3,137,890 A * 6/1964 Kochanowski ..... 16/87.2
5,230,494 A 7/1993 Adams

* cited by examiner

*Primary Examiner*—Sarah Purol

(57) ABSTRACT

A curtain rod mount that allows an individual to hang window shades in windows of varying widths. The curtain rod mount includes a central curtain rod that is adjustable in length, allowing an individual to mount the curtain rod mount in a window frame of a window without the need for drilling holes or hammering nails.

3 Claims, 3 Drawing Sheets

DESIGNER DORM ROD

I. CROSS-REFERENCE TO RELATED APPLICATIONS

This application claims the benefit of U.S. Provisional Application No. 60/546,644 filed Feb. 20, 2004.

II. BACKGROUND OF THE INVENTION

The present invention concerns that of a new and improved curtain rod mount that allows an individual to hang window shades in windows of varying widths.

III. DESCRIPTION OF THE PRIOR ART

U.S. Pat. No. 5,230,494 issued to Adams, discloses a mounting bracket for window treatments that is supported with a plurality of suction cups.

U.S. Pat. No. 2,257,014, issued to Jacobson, discloses a means for supporting a window shade without having fasteners enter the jambs.

U.S. Pat. No. 2,242,683, issued to Scott, discloses a curtain holder device that can be applied to any window without hole making fasteners like nails or screws and appears supported using rubber compressible elements.

IV. SUMMARY OF THE INVENTION

The present invention concerns that of a new and improved curtain rod mount that allows an individual to hang window shades in windows of varying widths. The curtain rod mount includes a central curtain rod that is adjustable in length and has two rubber end-mounts which will allow an individual to mount the curtain rod mount in a window frame of a window without the need for drilling holes or hammering nails.

There has thus been outlined, rather broadly, the more important features of a curtain rod mount that the detailed description thereof that follows may be better understood and in order that the present contribution to the art may be better appreciated. There are, of course, additional features of the curtain rod mount that will be described hereinafter and which will form the subject matter of the claims appended hereto.

In this respect, before explaining at least one embodiment of the curtain rod mount in detail, it is to be understood that the curtain rod mount is not limited in its application to the details of construction and to the arrangements of the components set forth in the following description or illustrated in the drawings. The curtain rod mount is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present curtain rod mount. It is important, therefore, that the claims be regarded as including such equivalent constructions insofar as they do not depart from the spirit and scope of the present invention.

It is therefore an object of the present invention to provide a curtain rod mount which has all of the advantages of the prior art and none of the disadvantages.

It is another object of the present invention to provide a curtain rod mount which may be easily and efficiently manufactured and marketed.

It is another object of the present invention to provide a curtain rod mount which is of durable and reliable construction.

It is yet another object of the present invention to provide a curtain rod mount which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
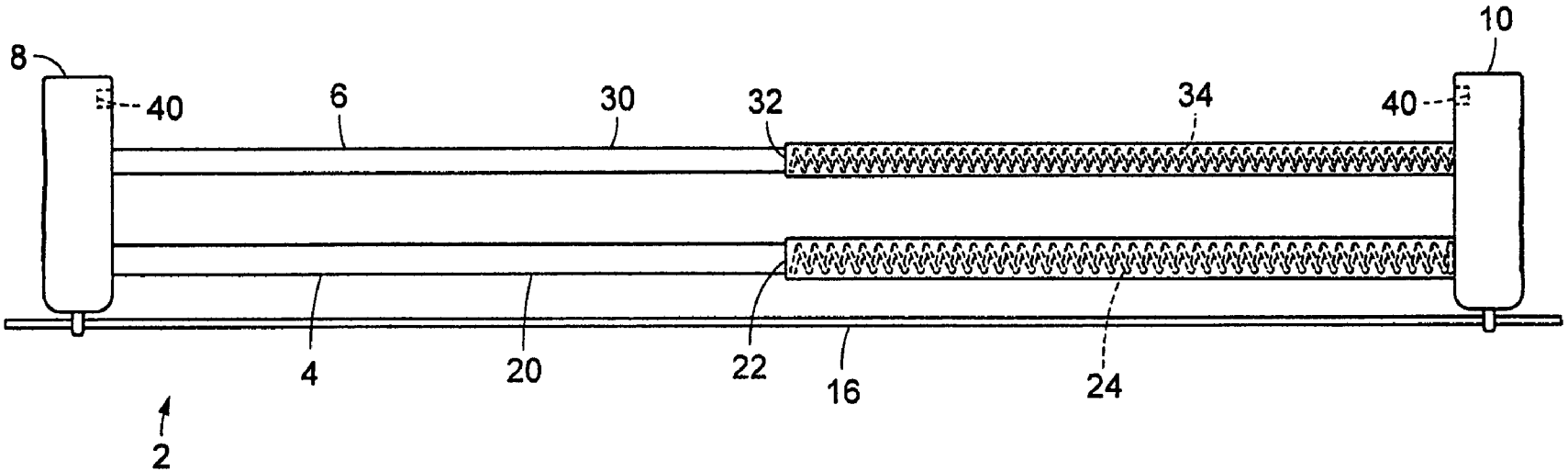
FIG. 1 shows a top view of the curtain rod mount of the present invention.
Figure 2:
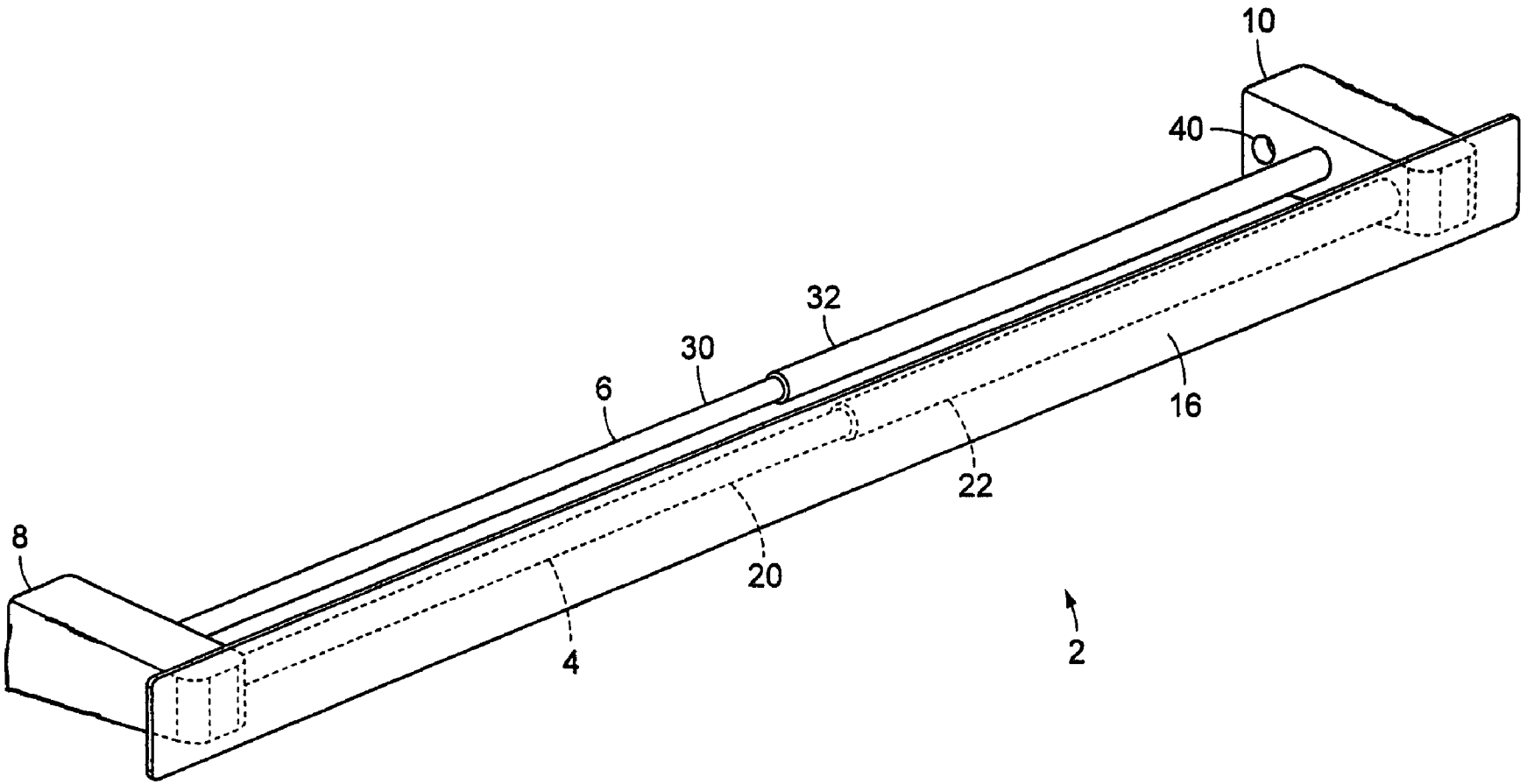
FIG. 2 shows a perspective view of the curtain rod mount of the present invention.

FIG. 1 shows a top view of the curtain rod mount 2 of the present invention, while FIG. 2 shows a perspective view of the curtain rod mount 2 of the present invention. Curtain rod mount 2 is designed to be mounted within a window frame near the top of a window so that an individual can properly hang a curtain, plurality of blinds, etc.

Curtain rod mount 2 comprises a curtain rod 4, a secondary bar 6, two end mounts 8 and 10, and a veneer strip 16. Curtain rod mount 2 is designed to be flexible in length, allowing the curtain rod mount 2 to be mounted within window frames of a wide variety of widths. The end mounts 8 and 10 can be fabricated from a wide variety of materials but preferably are fabricated from rubber.

Curtain rod 4 has two ends, a first end and a second end. Curtain rod 4 itself is fabricated from two separate poles, inner pole 20 and outer pole 22. The inner pole 20 is designed to be telescoping within the outer pole 22. Within outer pole 22 of curtain rod 4 is a spring 24 that allows curtain rod 4 to both be telescoping, as previously described, and also allows both ends of the curtain rod 4 to always push outward.

The first and second ends of curtain rod 4 are attached to end mounts 8 and 10, respectively. To properly mount the present invention, an individual would place the curtain rod mount 2 within a window frame so that the end mounts 8 and 10 are pressed against the side walls of the window frame. The outward-pushing pressure by the spring on the curtain rod 4 will help to keep the curtain rod 4 locked in place once it is properly placed within the window frame.

Secondary bar 6 also has two ends, a first end and a second end. Secondary bar 6 itself is fabricated from two separate poles, inner pole 30 and outer pole 32. Inner pole 30 is designed to be telescoping within outer pole 32. Within the outer pole 32 of the secondary bar 6 is a spring 34 that allows secondary bar 6 to both be telescoping, as previously described, and also allows both ends of the secondary bar 6 to always push outward. Secondary bar 6 is designed for support of an alternative or extra method of covering an adjacent window, with the support located on the secondary bar 6 possibly being a plurality of hooks, mini-blinds, or other types of window coverings that might involve a few different layers of fabric.

Each of the end mounts 8 and 10 has a plurality of holes 40, with the holes designed to allow the addition of shades at some time in the future. Usually, if an individual wants to use shades, a shade is wound around a rod that is axially mounted within the holes 40 so that the shade can be lowered or raised as needed.

Veneer strip 16 has two ends, a first end and a second end. The first end of the veneer strip 16 is attached to the end mount 8, while the second end of the veneer strip 16 is attached to the end mount 10. Once the curtain rod mount 2 is properly mounted, the veneer strip 16 hides from normal view the curtain rod 4 and secondary bar 6.

Figure 3:
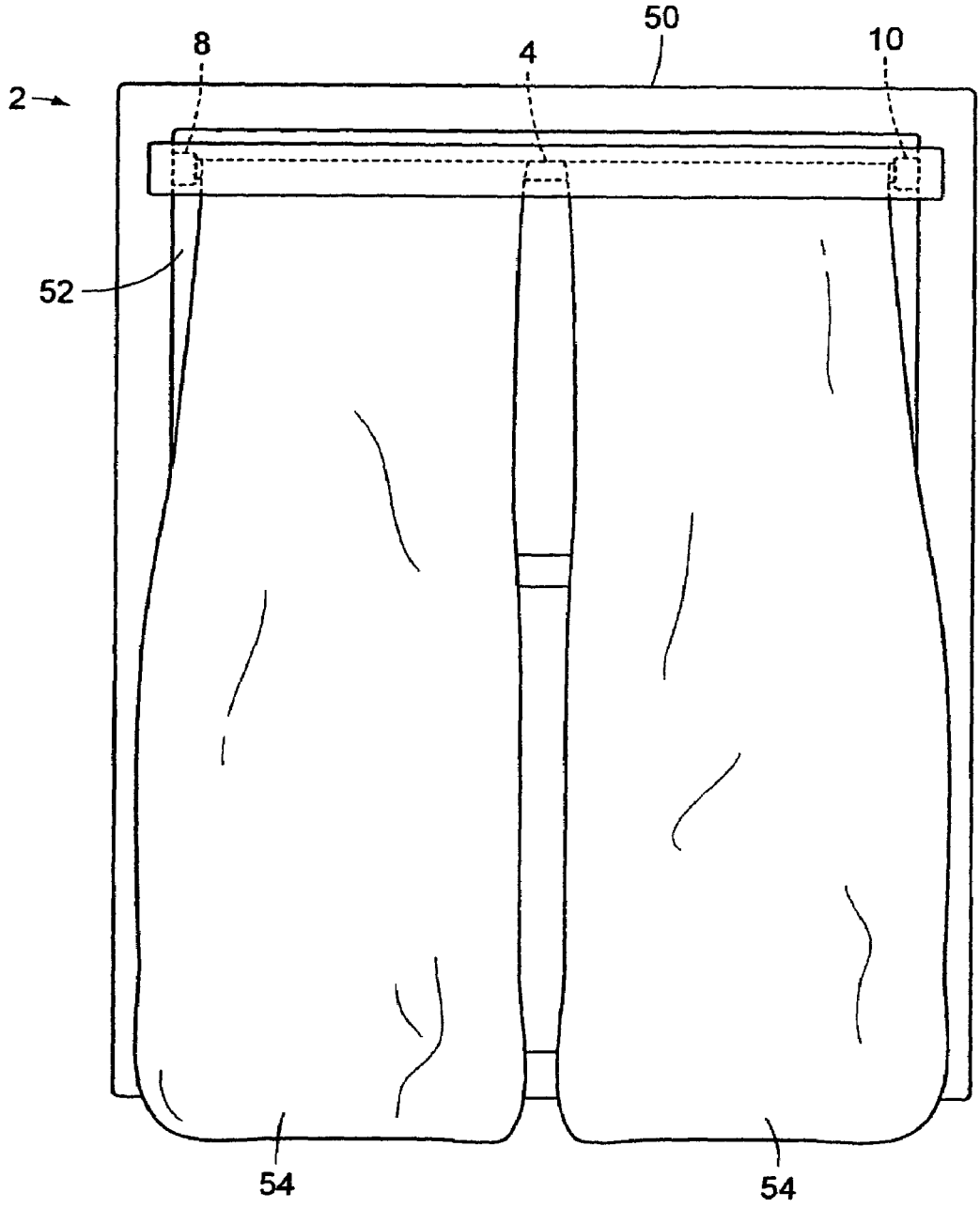
FIG. 3 shows a front view of the present invention as it would appear in use.

FIG. 3 shows a front view of the present invention as it would appear in use. Curtain rod mount 2 is located within a window frame 50 of a window 52. The end mounts 8 and 10 are wedged against the sides of the window frame 50 based on the outward-pushing force present on the curtain rod 4, providing extra grasping power for the present invention. A curtain 54 is shown to be hung from the curtain rod 4. In this representation, neither the secondary bar 6 nor the two holes 40 are used for an alternative or extra method of covering the window, but they are available if needed by an individual.

What I claim as my invention is:

1. A curtain rod mount comprising:

a curtain rod having a first end and a second end, the curtain rod comprising an inner pole and an outer pole, the inner pole being telescoping within the outer pole a first spring located within the outer pole of the curtain rod, wherein the first spring continually pushes outward against the inner pole, a secondary bar having a first end and a second end, the secondary bar comprising an inner pole and an outer pole, the inner pole of the secondary bar being telescoping within the outer pole of the secondary bar, a second spring located within the outer pole of the secondary bar, wherein the second spring continually pushes outward against the inner pole of the secondary bar, a pair of end mounts comprising a first end mount and a second end mount, wherein the first end mount is attached to the first end of the curtain rod and the first end of the secondary bar, further wherein the second end mount is attached to the second end of the curtain rod and the second end of the secondary bar, a curtain hung from the curtain rod, wherein the end mounts are placed within a window frame of a window, further wherein the end mounts are wedged against the window frame based upon the outward pressing force of the springs within the curtain rod and the secondary bar, thereby providing extra grasping power for the curtain rod mount, and wherein the curtain rod mount further comprises a veneer strip, the veneer strip having a first end and a second end, the first end of the veneer strip being attached to the first end mount, the second end of the veneer strip being attached to the second end mount.

2. A curtain rod mount according to claim 1 wherein each of the end mounts has a plurality of holes, wherein the holes can be used to place additional shades.

3. A curtain rod mount according to claim 1, wherein each of the end mounts are fabricated from rubber.

* * * * *